United States Patent [19]

Khare

[11] Patent Number: 4,714,499

[45] Date of Patent: Dec. 22, 1987

[54] FULL LENGTH FORGING METHOD FOR PRODUCING LARGE SECTION, LARGE MASS CYLINDRICAL SLEEVES OF ALLOY 625

[75] Inventor: Ashok K. Khare, Warren, Pa.

[73] Assignee: National Forge Company, Irvine, Pa.

[21] Appl. No.: 913,939

[22] Filed: Oct. 1, 1986

[51] Int. Cl.[4] ..... C22F 1/10

[52] U.S. Cl. ..... 148/11.5 N; 148/427

[58] Field of Search ..... 148/11.5 N, 2, 427

[56] References Cited

U.S. PATENT DOCUMENTS

| | | | |
|---|---|---|---|
| 1,437,690 | 12/1922 | Sylvester | 72/368 |
| 2,325,314 | 7/1943 | Harbart et al. | 29/156 |
| 3,260095 | 7/1966 | Flanagan | 72/265 |
| 3,943,748 | 3/1976 | King, Jr. | 72/393 |

OTHER PUBLICATIONS

"Manufacture of Heavy Press Forging", The Making, Shaping and Treating of Steel, Chap. 38, (9th Ed. 1971), pp. 1042–1053.

"Open-Die Forging", Forging of Nickel Alloys, Metals Handbook: Forging and Casting, vol. 5 (8th Ed. 1970), pp. 41–48 and 140–142.

Huntington Alloys, Inc. Brochure Entitled "Inconel Alloy 625".

*Primary Examiner*—R. Dean

*Attorney, Agent, or Firm*—Wayne M. Kennard

[57] ABSTRACT

A process for producing large section, large mass cylindrical sleeves of alloy 625 by employing full length saddle forging technique comprising forming the workpiece by forging it into a full length member, trepanning the member to form the workpiece, saddle forging the workpiece, air cooling the forging to room temperature following saddle forging, thermal treating and annealing the forging and finish machining the forging to form the finished large section, large mass cylindrical sleeve of alloy 625.

27 Claims, 3 Drawing Figures

FULL LENGTH FORGING METHOD FOR PRODUCING LARGE SECTION, LARGE MASS CYLINDRICAL SLEEVES OF ALLOY 625

TECHNICAL FIELD

The present invention relates to the field of processes for producing large section, large mass cylindrical sleeves of alloy 625. More specifically, the present invention relates to producing large section, large mass cylindrical sleeves of alloy 625 by employing a full length forging technique.

BACKGROUND

Alloy 625 is a solid-solution matrix-stiffened face-centered-cubic alloy at elevated, as well as room, temperatures. The strength of alloy 625 is derived from the stiffening effect of molybdenum and columbium on its nickel-chromium matrix. High tensile, creep and rupture strengh; outstanding fatigue and thermal-fatigue strength; oxidation resistance; excellent brazeability and weldability are some of the properties of this alloy. However, alloy 625 is a material with a very small hot working temperature range; and even though it is austenitic at room temperature, it is an inherently stiff material and difficult to move, especially in large section sizes.

In general, alloy 625 has good mechanical and physical properties for use as a wear surface and is resistant to salt water corrosion making it excellent for use in sea water applications. The specific properties of alloy 625 are reported in a brochure entitled "INCONEL alloy 625" by Huntington Alloys, Inc., Huntington, W. Va, a manufacturer of alloy 625. (INCONEL is a registered trademark of International Nickel Co.)

Initially, alloy 625 was developed as a sheet metal and had uses limited to sheet and tubing applications. Once it was demonstrated it could be successfully forged, it had other applications consistant with conventional forging techniques.

A proposed application of alloy 625 forgings is as a corrosion resistant protective sleeve for marine shafting. The advent of increased and expanded undersea exploration also makes it highly desirable as a high strength, corrosion resistant material that can be fabricated into structures (large section size and large mass), and/or used in rotating equipment. The operating conditions under which these large undersea structures and/or rotating equipment are subjected demand high and exacting properties.

Using conventional metal working methods, alloy 625 sleeves are formed by rolling the material into a plate, forming the plate into a sleeve, and seam welding the plate. However, the seam weld is a potential failure point for the sleeve.

For the most part, prior to the present invention, alloy 625 forgings were limited to small section size and small mass. To produce large section, large mass alloy 625 sleeves, it was necessary to weld together forged rings made by conventional methods from small or standard diameter ingots. These sleeves also suffer from the existence of welds in the finished product.

An exception to the conventional methods of forming large section, large mass sleeves discussed above is a method of forming them from large diameter ingots of alloy 625 described in the applicant's copending application filed June 22, 1986 having Ser. No. 875,479 also assigned to National Forge Company.

However, these prior methods of producing large section, large mass cylindrical sleeves from alloy 625 do not describe producing such sleeves using a full length forging technique.

The technology developed by the present invention not only provides a process for producing large section, large mass cylindrical sleeves of alloy 625 from full length workpieces, but also provides the specific thermo-mechanical procedures developed to provide uniformly high mechanical properties, high ductility, and a high fatigue limit in a product used in the corrosive sea water environment.

SUMMARY OF THE INVENTION

The present invention is a process for producing large section, large mass cylindrical sleeves of alloy 625 from full length workpieces.

In the novel process of the present invention, remelted ingots of alloy 625 are used to produce the workpieces. Remelted ingots with the same outside diameter as that desired for the finished workpiece are cut to the predetermined length and used "as is" in forming the workpiece. Remelted ingots with an outside diameter larger than that desired for the finished workpiece are forged to the predetermined outside dimensions of the workpiece. Remelted ingots with an outside diameter smaller than that desired for the finished workpiece are upset and forged down to the predetermined outside dimensions of the workpiece. Alternately, when forging is used, the ingot can be forged to a larger outside diameter than that desired for the finished workpiece and machined down to the predetermined dimensions of the workpiece.

The length of the finished workpiece in all cases is slightly longer than that desired for the large section, large mass cylindrical sleeve because of allowances for the standard forging tolerance on length plus the length of the test material.

The member formed by one of the above methods is then trepanned to form the finished workpiece. In trepanning the member, a bore of a predetermined diameter is formed along its longitudinal axis to accomodate a saddle forging mandrel bar for use in full length forging the workpiece.

After the workpiece is formed, it is heated to a temperature of 2000° F. and placed on a preheated saddle forging mandrel.

Subsequent to the workpiece's placement on the saddle forging mandrel, the mandrel is positioned on a pair of saddles. The distance between the saddles is slightly greater than the length of the workpiece. Accordingly, there is a small gap between each saddle and a respective end of the workpiece disposed on the mandrel.

Once the saddle forging mandrel with the workpiece disposed thereon is properly placed on the saddles, a manipulator engages a first end of the mandrel and a chain drive assembly engages the mandrel near the second end. The manipulator and chain drive assembly rotate the workpiece in steps during saddle forging, as will be described subsequently.

According to the full length saddle forging step of the novel process of the present invention, the full length of the workpiece is pressed by a flat top pressing die having a length greater than the length of the full length workpiece. The total length of the workpiece is worked at the same time so there is uniform work along the entire length of the workpiece. The workpiece is pressed at a particular press location by the pressing die and then successively rotated in steps to new press locations at which the workpiece is pressed by the pressing die. This procedure is followed during each heat until the workpiece opens up to the desired dimensions. In rotating the workpiece to the successive press locations, there is an overlap between the previous press location and the new press location.

At each press location, the workpiece is pressed with a 3000 ton press. During each heat, the workpiece is pressed between the top pressing die of the 3000 ton press and the saddle forging mandrel supported by the saddles. The manipulator and the chain drive assembly rotate the workpiece in steps and the top pressing die presses the workpiece at each location until the material stops moving.

After the workpiece stops moving, it is reheated to a temperature of 2000° F. and placed on the preheated saddle forging mandrel. The mandrel is again properly positioned on the saddles, and the manipulator engages the first end of the mandrel and the chain drive assembly engages the mandrel near the second end.

Following this, the workpiece is pressed in the previously described manner until it stops moving. The preceding procedure is repeated until the workpiece opens to the desired dimensions.

Subsequent to saddle forging the workpiece is air cooled to room temperature. Then, it is thermal treated followed by annealing. Once the annealing step is completed, the workpiece is tested for properties and then finish machined.

An object of the invention is to provide a process for producing large section, large mass cylindrical sleeves from full length workpieces of alloy 625 using a full length forging technique.

This and other objects will be described in greater detail in the remaining portions of the specification.

BEST MODE FOR CARRYING OUT THE INVENTION

The present invention is a novel process for producing large section, large mass forged cylindrical sleeves of alloy 625 using a full length forging technique.

The limiting chemical composition by weight percentage of alloy 625, as reported in the brochure entitled "INCONEL alloy 625" by Huntington Alloys, Inc., Huntington, W. Va., is shown in Table 1.

TABLE 1

| Element | % by weight |
|---|---|
| Nickel | 58.0 min. |
| Chromium | 20.0–23.0 |
| Iron | 5.0 max. |
| Molybdenum | 8.0–10.0 |

TABLE 1-continued

| Element | % by weight |
|---|---|
| Columbium (plus Tantalum) | 3.15–4.15 |
| Carbon | 0.10 max. |
| Silicon | 0.50 max. |
| Manganese | 0.50 max. |
| Phosphorus | 0.015 max. |
| Sulfur | 0.015 max. |
| Aluminum | 0.40 max. |
| Titanium | 0.40 max. |
| Cobalt (if determined) | 1.0 max. |

The physical and mechanical properties of and forging temperature ranges for alloy 625 are reported in the Huntington Alloy, Inc. brochure and *Metals Handbook Vol. 5: Forging and Casting,* "Forging of Nickel Alloys," (8th Ed. 1970), pp. 139–42, respectively, and is understood by one skilled in the art without further disclosure herein.

Figure 1:
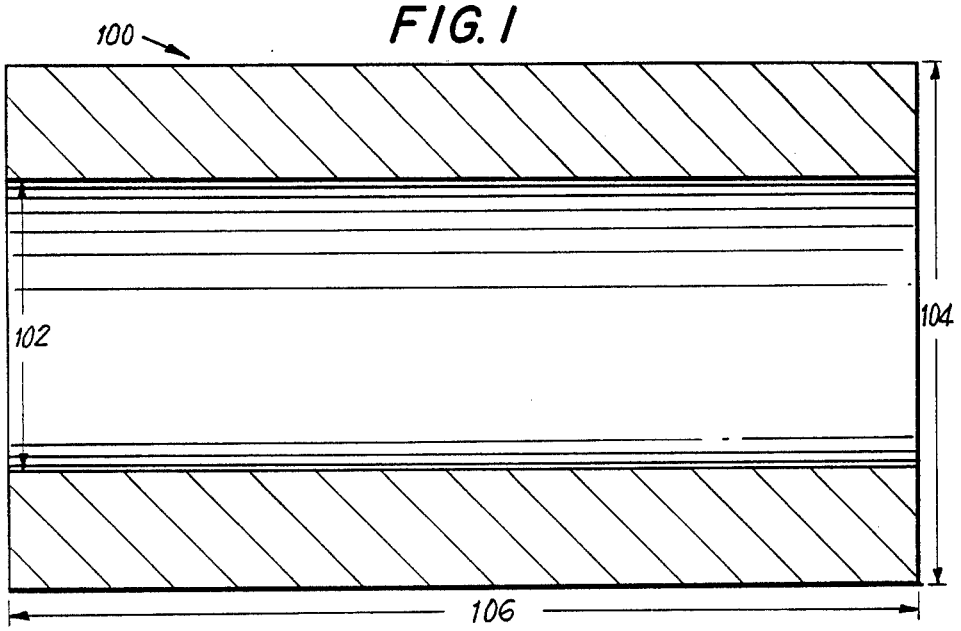
FIG. 1 shows a cross-sectional view of the full length workpiece prior to saddle forging.

Referring to FIG. 1, preferably, workpiece 100 is formed from a 33 inch diameter remelted ingot of alloy 625. To form the workpiece, the ingot is forged into a member having the predetermined outside dimensions of the finished workpiece, i.e., an outside diameter of 24½ inches at 104 and a length of 63 inches at 106. The member is then trepanned with a 15½ inch bore, shown at 102, along its longitudinal axis to form finished workpiece 100. The 63 inch length is slightly longer than the desired full length of the finished cylindrical sleeve because of allowances for standard forging tolerance on length plus the length of the test material.

Workpiece 100 can also be formed from a 33 inch diameter remelted ingot by forging the ingot into a member having a 27 inch outside diameter and a length of 63 inches. After forging, the member is trepanned with a 15½ inch diameter bore along the longitudinal axis. Following this, the member is machined to form workpiece 100 shown in FIG. 1.

Workpiece 100 is formed by one of the above described methods when the remelted ingot has a diameter equal to or greater than 30 inches. When the starting remelted ingot has a diameter less than 30 inches, workpiece 100 is formed by one of three other methods. If the ingot's outside diameter is equal to that desired for the workpiece, a full length member is cut from the ingot. Then, the member is trepanned with a 15½ inch diameter bore along the longitudinal axis to form the workpiece. If the ingot's outside diameter is greater than that desired for the workpiece but less than 30 inches, it is trepanned with a 15½ bore and then machined down to the desired dimensions. If the ingot's outside diameter is less than that desired for the workpiece, it is upset so that at least part of its outside diameter is greater than that desired for the workpiece. Next, the upset member is forged to the desired outside dimensions of the workpiece. Finally, the member is trepanned to form the finished workpiece.

Figure 2:
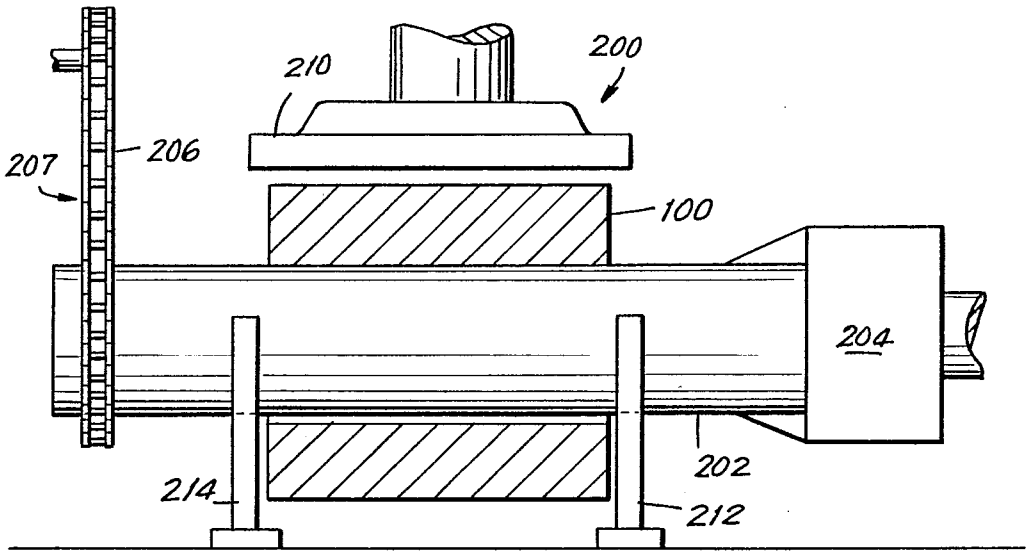
FIG. 2 shows the saddle forging mandrel with the workpiece of FIG. 1 (in cross-section) disposed thereon properly positioned on the saddles, the pressing die positioned over the full length workpiece and the mandrel rotation means engaging the respective ends of the saddle forging mandrel.

Once formed, workpiece 100 is saddle forged. The saddle forging equipment, at least in part, is generally shown in FIG. 2 at 200. Saddle forging mandrel 202 has a 15 inch outside diameter, a 2 inch inside diameter, a length of 120 inches and is preferably constructed of alloy 718.

Saddle forging mandrel 202 is supported by saddles 212 and 214. Saddles 212 and 214 are specifically positioned with respect to workpiece 100 in supporting mandrel 202, as will be described subsequently.

Saddle forging mandrel 202 is rotated during saddle forging by manipulator 204 which engages a first end of mandrel 202 and chain drive assembly 207 which engages mandrel 202 near the second end.

Flat top pressing die 210 is disposed above workpiece 100. Pressing die 210 is part of a 3000 ton press used for working workpiece 100 during saddle forging.

Alternatively, a plurality of saddle forging mandrels are used in saddle forging workpiece 100. The initial mandrel has an outside diameter of 15 inches which is close to the inside diameter of workpiece 100 as originally formed. As the inside diameter of workpiece 100 opens up, the mandrel is changed to one with a larger diameter so that the outside diameter of the saddle forging mandrel remains close in size to the inside diameter of the workpiece 100.

During the full length saddle forging step, workpiece 100 is heated to 2000° F. and placed on the saddle forging mandrel 202 preheated to 600°-800° F. Mandrel 202 with workpiece 100 disposed on it is then placed on saddles 212 and 214. The distance between saddles 212 and 214 is slightly greater than the length of workpiece 100. Hence, saddle 212 is adjacent one end of workpiece 100 and saddle 214 is adjacent to the other end of workpiece 100. Minimal gaps are formed between the points where saddles 212 and 214 support mandrel 202 and the respective ends of workpiece 100 disposed on the mandrel. However, the gaps are great enough to allow unobstructed rotation of workpiece 100 on mandrel 202. Further, the saddles are positioned in this manner to reduce the unsupported length of mandrel 202 between them to help prevent the mandrel from breaking during saddle forging. The close saddle placement also prevents unnecessary deflection of mandrel 202 which causes non-uniformity in wall thickness of the workpiece during saddle forging.

Manipulator 204 engages the first end of mandrel 202 and chain drive assembly 207 engages mandrel 202 near the second end. Manipulator 204 and chain drive assembly 207 rotate mandrel 202 and workpiece 100, as will be described. FIG. 2 shows the end of manipulator 204 engaging the first end mandrel 202, and chain 206 of chain drive assembly 207 engaging mandrel 202 near the second end. The remaining portions of chain drive assembly 207 and manipulator 204 are known by one skilled in the art without further explanation.

Following placement of saddle forging mandrel 202 with workpiece 100 disposed on it on saddles 212 and 214, and engagement of the ends of mandrel 202 by manipulator 204 and chain drive assembly 207, workpiece 100 is worked with flat top pressing die 210 of the 3000 ton press. Pressing die 210 has a length greater than full length workpiece 100 and, preferably, has a width of 18 inches. Pressing die's length is greater than that of workpiece 100 to prevent longitudinal expansion of workpiece 100 during full length saddle forging. Although, preferably, an 18 inch wide die is used, dies having other widths can be successfully used for the saddle forging step.

During saddle forging, pressing die 210 presses workpiece 100 at a first position, then workpiece 100 is rotated to the next press location by and pressed with pressing die 210 at the new press location. During each press, workpiece 100 is deformed full length. When workpiece 100 is rotated to each successive press location, the new press location overlaps the previous location. The press locations are overlapped to maintain the roundness of workpiece 100 during saddle forging.

As workpiece 100 is rotated on mandrel 202 and successively pressed by pressing die 210, the inside diameter of workpiece 100 opens up. Workpiece 100 is saddle forged in this manner during each heat until the material stops moving.

When workpiece 100 stops moving, it is removed from saddle forging mandrel 202 and reheated to a temperature of 2000° F and again placed on mandrel 202 preheated to 600° -800° F. Mandrel 202 with workpiece 100 on it is positioned on the saddles 212 and 214 and engaged by manipulator 204 and chain drive assembly 207, as previously described. Workpiece 100 is then full length saddle forged as previously described between saddle forging mandrel 202 and pressing die 210. Workpiece 100 is again worked until the material no longer moves.

After this, workpiece 100 is reheated and worked as described for a predetermined number of heats until the last heat. For the last heat, the workpiece is reheated to 2000° F. and placed on preheated mandrel 202. Then, mandrel 202 with workpiece 100 on it is positioned on saddles 212 and 214, and the ends of mandrel 202 are engaged by manipulator 204 and chain drive assembly 207. However, workpiece 100 is not worked until after its temperature has cooled to below 1950° F. After this, it is worked to achieve the desired rough dimensions of the finished forged large section, large mass cylindrical sleeve. Preferably, the full length saddle forging step is carried out in four heats.

In a second embodiment of the method of the present invention, workpiece 100 is reheated to only a temperature of 1950° F. for heats two, three and four before it is placed on the preheated saddle forging mandrel. Then, it is worked in the same manner as described for the preferred embodiment.

During saddle forging, the saddle forging mandrel is water cooled. The water cooling keeps the mandrel temperature below 1000° F. during the saddle forging step. Water cooling is commenced after each heat starts and continues throughout the remainder of the heat.

Following saddle forging, workpiece 100 is allowed to air cool to room temperature. Subsequent to air cooling, workpiece 100 is thermal treated then annealed. Thermal treatment for mechanical properties followed by annealing at 1700° F. is carried out on the "as forged" workpiece. Thermal treatment and annealing are accomplished according to the Huntington Alloy, Inc. brochure which is understood by one skilled in the art without further explanation.

Figure 3:
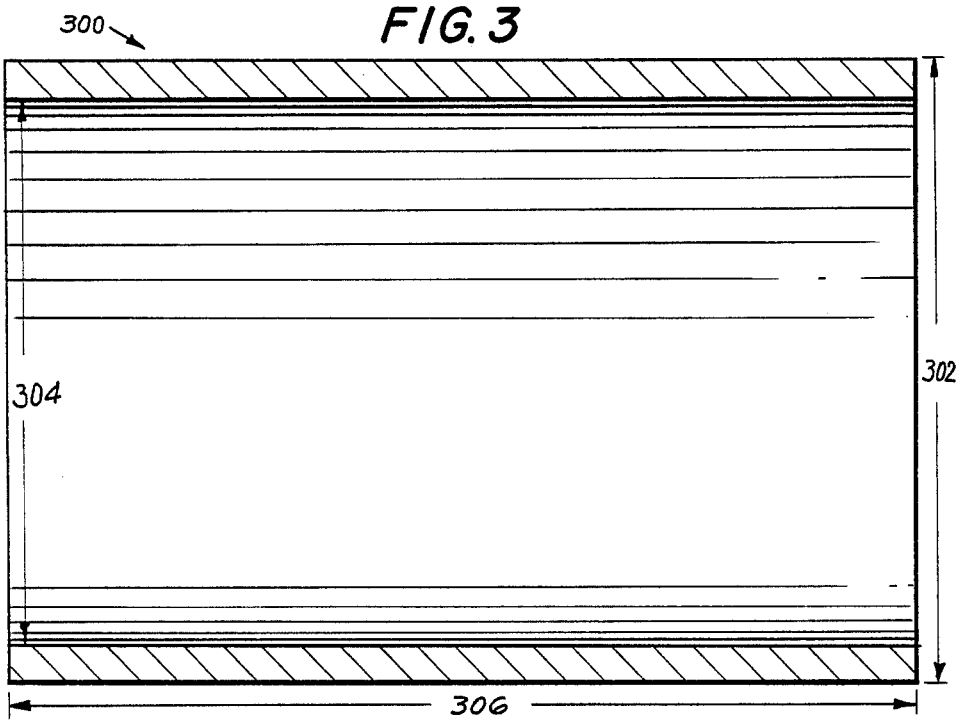
FIG. 3 shows the large section, large mass cylindrical sleeve produced from the full length workpiece of alloy 625 shown in FIG. 1 prior to finished machining.

Following annealing but prior to finish machining, the finished full length forging generally shown in FIG. 3 at 300 is tested for properties.

After testing for properties, finished forging 300 is finish machined to form the large section, large mass forged cylindrical sleeve of alloy 625 of the desired dimensions.

EXPERIMENT

A large section, large mass cylindrical sleeve of alloy 625 was produced using the full length forging technique of the present invention. The average cold dimensions of finished forging 300 are an outside diameter of 29½ inches at 302, an inside diameter of 23 inches at 304, and a length of 64½ inches at 306.

The results of the mechanical property evaluation performed in the tangential direction on finished forging 300, taken from a full length prolongation was:

TABLE 2

| Tensile (ksi) | 0.2% Yield (ksi) | % EL | % RA |
|---|---|---|---|
| 120.7 | 72.2 | 57.0 | 53.3 |

The terms and expressions which are employed herein are used as terms of expression and not of limitation. And, there is no intention, in the use of such terms and expressions, of excluding the equivalents of the features shown, and described, or portions thereof, it being recognized that various modifications are possible within the scope of the invention.

I claim:

1. A process for producing a large section, large mass sleeve of alloy 625 consisting essentially of a limiting composition by weight percentage of 58.0 min. nickel, 20.0–23.0 chromium, 5.0 max. iron, 8.0–10.0 molybdenum, 3.15–4.15 columbium (plus tantalium), 0.10 max. carbon, 0.50 max. manganese, 0.50 max. silicon, 0.015 max. phosphorus, 0.015 max. sulphur, 0.40 max. aluminum, 0.40 titanium, and 1.0 max. cobalt (if determined), comprising the steps of:

(a) forming a workpiece from an ingot, with the formed workpiece having a length slightly longer than the predetermined full length of the finished large section, large mass cylindrical sleeve and a trepan bore of a predetermined diameter along the longitudinal axis;

(b) saddle forging the workpiece which further comprises the substeps of, (1) heating the workpiece to a temperature of 2000° F., (2) placing the workpiece on a preheated saddle forging mandrel, (3) placing the saddle mandrel with the workpiece disposed thereon on a pair of saddles, with the saddles being positioned such that a first saddle supports a first end of the saddle forging mandrel and a second saddle supports a second end of the saddle forging mandrel with a small gap being formed between a first end of the workpiece disposed on the saddle forging mandrel and the first saddle and a small gap being formed between a second end of the workpiece disposed on the saddle forging mandrel and the second saddle, (4) engaging a first end of the saddle forging mandrel with a manipulator means and engaging the saddle forging mandrel near the second end with a chain drive assembly, (5) working the workpiece by rotating the workpiece in steps with the manipulator means and the chain drive assembly and at each step applying a saddle forging die having a length longer than the full length of the workpiece, with the saddle forging die applying a pressure of 3000 tons to the workpiece at each step until the workpiece stops moving, with each successive step being an amount which allows an overlap of a new step's press location with the previous step's press location, (6) reheating the workpiece to a temperature of 2000° F. and repeating substeps (b)(2), (3), (4) and (5) for a predetermined number of heats, (7) reheating the workpiece to a temperature of 2000° F. for the final heat, repeating steps (b)(2), (3) and (4) and then repeating substep (b)(5) after the workpiece cools to a temperature below 1950° F., and (8) air cooling the workpiece to room temperature;

(c) thermal treating the workpiece followed by annealing the workpiece; and (d) finish machining the workpiece to form the finished large section, large mass cylindrical sleeve.

2. The process as recited in claim 1, wherein forming the workpiece further comprises the substeps of, (1) forging the ingot to a member having a predetermined outside diameter and a length slightly longer than the predetermined full length of the finished large section, large mass cylindrical sleeve, and (2) trepanning a bore of a predetermined diameter along the longitudinal axis of the forged member.

3. The process as recited in claim 2, wherein forming the workpiece from an ingot further includes forming the workpiece from an ingot having an outside diameter greater than or equal to 30 inches.

4. The process as recited in claim 1, wherein forming the workpiece from an ingot further comprises the substeps of, (1) forging the ingot to a member having an outside diameter larger than the predetermined outside diameter of the finished workpiece and a length slightly longer than the predetermined full length of the finished large section, large mass cylindrical sleeve, (2) trepanning a bore of a predetermined diameter along the longitudinal axis of the forged member, and (3) machining the outside diameter of the forged member down to the predetermined outside diameter of the finished workpiece.

5. The process as recited in claim 4, wherein forming the workpiece from an ingot further includes forming the workpiece from an ingot having an outside diameter greater than or equal to 30 inches.

6. The process as recited in claim 1, wherein forming the workpiece from an ingot further comprises the substeps of, (1) cutting a member having a length slightly longer than the predetermined full length of the finished large section, large mass cylindrical sleeve from an ingot, and (2) trepanning a bore of a predetermined diameter along the longitudinal axis of the member.

7. The process as recited in claim 6, wherein forming the workpiece from the ingot further includes forming the workpice from an ingot having a diameter equal to the predetermined diameter of the finished workpiece.

8. The process as recited in claim 6, wherein forming the workpiece from an ingot with a diameter greater than the predetermined outside diameter of the finished workpiece up to 30 inches further includes the substep of machining the outside diameter of the ingot after substep (2) down to the predetermined outside diameter of the finished workpiece.

9. The process as recited in claim 1, wherein forming the workpiece further comprises the substeps of, (1) upsetting the ingot to form a member having outside diameter with at least a portion larger than the predetermined outside diameter of the finished workpiece, (2) forging the member to a predetermined outside diameter and a length slightly longer than the full length of the finished large section, large mass cylindrical sleeve, and (3) trepanning a bore of a predetermined diameter along the longitudinal axis of the member.

10. The process as recited in claim 9, wherein forming the workpiece from an ingot includes forming the workpiece from an ingot having an outside diameter less than the predetermined outside diameter of the finished workpiece.

11. The process as recited in claim 1, wherein forming the workpiece further comprises the substeps of, (1) upsetting the ingot to form a member having an outside diameter with at least a portion larger than the predetermined outside diameter of the finished workpiece, (2) forging the member to an outside diameter larger than the predetermined outside diameter of the finished workpiece and a length slightly longer than the full length of the finished large section, large mass cylindrical sleeve, (3) trepanning a bore of a predetermined diameter along the longitudinal axis of the member, and (4) machining the outside diameter of the member to the predetermined outside diameter of the finished workpiece.

12. The process as recited in claim 11, wherein forming the workpiece from an ingot includes forming the workpiece from an ingot having an outside diameter less than the predetermined outside diameter of the finished workpiece.

13. The process as recited in claim 1, wherein substep (b)(2) further comprises trepanning the member with a bore having a diameter of approximately 15 ½ inch.

14. The process as recited in claim 2, wherein substep (1) further comprises forging the ingot to an outside diameter of approximately 24½ inches and a length of approximately 63 inches.

15. The process as recited in claim 4, wherein substep (1) further comprises forging the ingot to an outside diameter of approximately 27 inches and a length of approximately 63 inches, and substep (3) further comprises machining the member from the outside diameter of approximately 27 inches to an outside diameter of approximately 24½ inches.

16. The process as recited in claim 9, wherein substep (2) further comprises forging the ingot to an outside diameter of approximately 24½ inches and a length of approximately 63 inches.

17. The process as recited in claim 11, wherein substep (1) further comprises forging the ingot to an outside diameter of approximately 27 inches and a length of approximately 63 inches, and substep (4) further comprises machining the member from the outside diameter of approximately 27 inches to an outside diameter of approximately 24½ inches.

18. The process as recited in claim 1, wherein step (b) further comprises saddle forging the workpiece with a plurality of saddle forging mandrels, with each successive saddle forging mandrels having a larger diameter.

19. The process as recited in claim 1, wherein step (b) further comprises saddle forging the workpiece with a saddle forging mandrel constructed from alloy 718.

20. The process as recited in claim 1, wherein substep (b)(3) further comprises positioning the mandrel on the saddles such that the saddles are spaced away from the ends of the workpiece a minimal amount sufficient to allow unobstructed rotation of the workpiece on the mandrel.

21. The process as recited in claim 1, wherein working the workpiece according to substep (b)(5) further comprises working the workpiece with a flat top die.

22. The process as recited in claim 21, wherein working the workpiece according to substep (b)(5) includes working the workpiece with an 18 inch wide flat top die.

23. The process as recited in claim 1, wherein working the workpiece according to substep (b)(5) further comprises deforming the workpiece along the full length at each pressing step.

24. The process as recited in claim 1, wherein preheating the saddle forging mandrel comprises preheating the saddle forging mandrel to 600–800° F.

25. The process as recited in claim 1, wherein step (b) further comprises maintaining the saddle forging mandrel at a temperature below 1000° F. during substep (b)(5).

26. The process as recited in claim 25, wherein maintaining the saddle forging mandrel at a temperature below 1000° F. comprises circulating water through the saddle forging mandrel during substep (b)(5).

27. The process as recited in claim 1, wherein the process further comprises completing substeps (b)(5), (6) and (7) in four heats.

* * * * *